US007069703B2

(12) United States Patent
Colefax et al.

(10) Patent No.: US 7,069,703 B2
(45) Date of Patent: Jul. 4, 2006

(54) METHOD AND SYSTEM FOR CONSTRUCTING LARGE, CONTINUOUS, CONCRETE SLABS

(75) Inventors: Warwick Ian Colefax, New South Wales (AU); Robert Foster Colefax, Queensland (AU); Miro Getaldic, New South Wales (AU)

(73) Assignee: Building Innovations Pty Ltd, Elanora Heights (AU)

( * ) Notice: Subject to any disclaimer, the term of this patent is extended or adjusted under 35 U.S.C. 154(b) by 0 days.

(21) Appl. No.: 10/357,867

(22) Filed: Feb. 4, 2003

(65) Prior Publication Data

US 2003/0115823 A1 Jun. 26, 2003

Related U.S. Application Data

(63) Continuation of application No. PCT/AU01/00950, filed on Aug. 3, 2001.

(30) Foreign Application Priority Data

Aug. 4, 2000 (AU) ..... 51830/00
May 15, 2001 (AU) ..... PR4999

(51) Int. Cl.
*E04C 5/16* (2006.01)

(52) U.S. Cl. ..... 52/677; 52/685; 52/649.8; 52/742.15; 52/340; 404/135; 404/62

(58) Field of Classification Search ..... 52/677, 52/685–699, 742.13–742.15, 741.11, 340, 52/576–577, 649.8; 248/74.1–74.4, 505, 248/440; 407/136, 47, 51; 249/9, 192; 404/47, 404/51, 62, 70–71, 135–136
See application file for complete search history.

(56) References Cited

U.S. PATENT DOCUMENTS

| | | | | |
|---|---|---|---|---|
| 1,613,351 | A * | 1/1927 | Klinger et al. | 404/135 |
| 2,329,189 | A * | 9/1943 | Dill | 404/17 |
| 3,434,401 | A | 3/1969 | Kiewit | |
| 3,567,816 | A * | 3/1971 | Embree | 52/223.6 |
| 3,575,094 | A | 4/1971 | Hewitt et al. | |
| 3,830,032 | A * | 8/1974 | Robb | 52/687 |
| 3,871,787 | A | 3/1975 | Stegmeier | |
| 3,873,220 | A * | 3/1975 | Kashiwabara | 403/172 |
| 4,144,685 | A * | 3/1979 | Fox | 52/223.6 |

(Continued)

FOREIGN PATENT DOCUMENTS

AU 87130/82 B 9/1987

(Continued)

OTHER PUBLICATIONS

Spears, Concrete Floors on Ground, 2nd Ed., *Portland Cement Association*, pp. 18-20 (1990).

*Primary Examiner*—Winnie Yip
(74) *Attorney, Agent, or Firm*—Akin Gump Strauss Hauer & Feld, LLP

(57) ABSTRACT

A method and system are provided for constructing large, continuous, concrete slabs without using conventional shrinkage joints. The system comprises a grid of closely-spaced crack inducers (2) arranged relative to a concrete-pouring surface and adapted to be covered by concrete. The crack inducers (2) may be connected to one another with connectors (10). The crack inducers (2) are of a size, shape and spacing to promote formation of fine cracks in the vicinity of the inducers (2) throughout the slab when the concrete sets.

44 Claims, 6 Drawing Sheets

FIG. 4

U.S. PATENT DOCUMENTS

| | | | | | |
|---|---|---|---|---|---|
| 4,682,461 | A | | 7/1987 | Sizemore | |
| 4,815,886 | A | | 3/1989 | Madsen | |
| 4,835,933 | A | * | 6/1989 | Yung | 52/685 |
| 4,953,340 | A | | 9/1990 | Anderson | |
| 5,337,532 | A | | 8/1994 | Reid | |
| 5,586,416 | A | | 12/1996 | Hess et al. | |
| 5,729,949 | A | | 3/1998 | Hartzheim | |
| 5,736,676 | A | | 4/1998 | Stelter et al. | |
| 5,831,212 | A | | 11/1998 | Whitehead et al. | |
| 5,857,302 | A | | 1/1999 | Lill | |
| 5,918,428 | A | | 7/1999 | Hough | |
| 5,956,912 | A | | 9/1999 | Carter et al. | |
| 6,089,522 | A | | 7/2000 | Haslem et al. | |
| 6,092,960 | A | * | 7/2000 | McCallion | 404/70 |
| 6,112,494 | A | * | 9/2000 | Hardy et al. | 52/685 |
| 6,171,016 | B1 | * | 1/2001 | Pauls et al. | 404/64 |
| 6,279,274 | B1 | * | 8/2001 | Amiet et al. | 52/125.2 |
| 6,413,004 | B1 | * | 7/2002 | Lin | 403/176 |
| 6,447,203 | B1 | * | 9/2002 | Ruiz et al. | 404/70 |
| 2004/0055235 | A1 | | 3/2004 | Valentine et al. | |

FOREIGN PATENT DOCUMENTS

| | | | | |
|---|---|---|---|---|
| AU | 44382/93 | A | | 2/1994 |
| AU | 34409/95 | | | 10/1995 |
| AU | 199852686 | B2 | | 7/1998 |
| AU | 199876170 | A1 | | 7/1998 |
| DE | 24 47 816 | A1 | | 7/1975 |
| DE | 28 25 979 | A1 | | 12/1979 |
| EP | 0053977 | A1 | | 12/1981 |
| EP | 0 010 883 | B1 | | 1/1982 |
| GB | 1 570 396 | | | 7/1980 |
| GB | 2 045 310 | A | | 10/1980 |
| GB | 2077319 | | * | 12/1981 |
| GB | 2 169 982 | A | | 7/1986 |
| GB | 2 330 890 | A | | 5/1999 |
| JP | 6-185127 | | | 7/1994 |

* cited by examiner

METHOD AND SYSTEM FOR CONSTRUCTING LARGE, CONTINUOUS, CONCRETE SLABS

CROSS-REFERENCE TO RELATED APPLICATIONS

This is a continuation of International Patent Application No. PCT/AU01/00950, filed Aug. 3, 2001, which was published in the English language on Feb. 14, 2002 under International Publication No. WO 02/12630 A1, and the disclosure of which is incorporated herein by reference.

BACKGROUND OF THE INVENTION

This invention relates to a method and to a system for constructing large continuous concrete slabs using closely spaced, cast-in crack inducers.

Large concrete slabs such as commercial, retail and industrial floors, and continuous pavements such as concrete roadways and paths will crack during the hydration period due to drying shrinkage of the concrete and other effects if they are not detailed to accommodate the shrinkage strains. In the absence of shrinkage control joints, cracks will typically occur in concrete slabs and pavements in the first three months after placing, and these cracks will normally meander through the concrete at random locations.

Uncontrolled, visible cracks in concrete slabs and pavements are generally perceived by those observing them as ugly at best and as failures at worst. Furthermore, the uncontrolled cracks are weak regions, which may fail under load, and uncontrolled cracks will widen and crumble under heavy traffic.

To remedy this problem in a conventional manner, shrinkage control joints of various types are introduced to provide a structural break in an attempt to accommodate and control the concrete shrinkage in predetermined locations. Although vastly superior to uncontrolled cracking, conventional control joints are expensive to install, and they are often the first point of failure in floor slabs and pavements.

The control joints are vulnerable to damage in traffic areas, usually due to impact, and they become unsightly when the slab edges break away and when sealants fail. They can also be a hazard for pedestrians and some random cracks often still occur despite the installation of a pattern of control joints.

There are a number of different control joints that are typically specified by engineers in the construction industry to accommodate shrinkage cracking of concrete slabs and pavements. One of the most popular control joints is a saw cut that is installed once the concrete has cured to the extent that it will support a worker. The depth of a suitable saw cut is typically twenty five percent of the total thickness of the slab and the spacing is typically three to six meters. Such a joint does not prevent cracking, but attempts to limit cracking to the saw cut locations and generally attempts to control cracking to straight lines. To achieve a relatively smooth finish and to seal the joint, saw cuts are usually filled with a suitable elastomeric material.

Unfortunately, this method is time consuming and involves a worker revisiting the slab after it has set to install the saw cut, and yet again to install the sealant. The additional time and material add to the cost of preparing the concrete slab.

Other traditional and commonplace shrinkage control joints include formed dowel joints, keyed joints and tooled joints.

U.S. Pat. No. 6,092,960 relates to a concrete joint restraint system, which secures dowel bars to a support structure. Use of dowel bars for transferring shear loads at joints in concrete pavement is known, and may provide a means to transfer forces across a joint. Using the invention of this patent, however, requires additional time and materials, and the use of joints.

U.S. Pat. No. 5,857,302 provides a means for controlling concrete slab cracking near walls or columns. The patent describes an outwardly extending vane perpendicular to the wall or column before pouring the concrete. The vane is orientated in line with a saw cut, which is made after the concrete has set. Although this invention directs cracking in a straight line near walls or columns, additional time and labor are still required in making the saw cuts.

BRIEF SUMMARY OF THE INVENTION

It is an object of the invention to provide a method and a system for constructing a large continuous concrete slab that overcomes or at least minimizes a disadvantage referred to above.

According to a first aspect of the invention, there is provided a method of constructing a large continuous concrete slab, the method comprising the steps of:

arranging a plurality of crack inducers relative to a concrete-pouring surface;

pouring concrete onto the concrete-pouring surface to completely cover the inducers; and allowing the concrete to set to form a slab;

wherein the inducers are of a size, shape and spacing to promote fine cracking in their vicinity throughout the area of the slab, such that the slab has a continuous top surface and does not require the installation of shrinkage control joints through the top surface to prevent uncontrolled cracking.

According to a second aspect of the invention, there is provided a crack inducer system for inducing cracks in a large continuous concrete slab, the system comprising a plurality of crack inducers arranged relative to a concrete-pouring surface and adapted to be completely covered by concrete, wherein the inducers are of a size, shape and spacing to promote fine cracking in their vicinity throughout the area of the slab when the concrete sets, and wherein the slab has a continuous top surface and does not require the installation of shrinkage control joints through the top surface to prevent uncontrolled cracking.

The phrase "large continuous concrete slab" is used herein to denote a slab panel that has a surface area usually of at least about 500 $m^2$, wherein "large" means length alone or length and breadth, and wherein "continuous" means without control joints. It is to be understood, however, that a "large continuous slab" can include a slab panel that has a surface area of, say, about 100 $m^2$, 200 $m^2$, 300 $m^2$ or 400 $m^2$.

The phrase "concrete-pouring surface" is used herein to denote either an even surface or an uneven surface.

The instant method and system of slab construction teach away from traditional approaches used to control contraction movements of a concrete slab. As opposed to increasing the size of unrestrained slab panels with control joints and increased reinforcement, the present invention teaches in effect increasing slab panels to virtually limitless size and decreasing the reinforcement. This is achieved by introducing closely spaced crack inducers to induce fine cracking throughout the slab panel. It has been discovered that closely spaced crack inducers distribute all shrinkage and thermal contraction cracking throughout the length and breadth of the slab. The cracks are induced at the moment the concrete begins to set. The fine cracks produced in the vicinity of the inducers are hardly visible and are generally of no structural consequence to the performance of the slab. As such, continuous slabs can be constructed, and a slab panel can be as large as necessary.

Not wishing to be bound by theory, it is believed that the fine cracking results from the fact that the thickness of the slab between a top of a crack inducer and the slab surface is less than the thickness of slab between adjacent inducers. A rounded upper surface of an inducer may provide a broad surface from which cracks may originate in a discontinuous or segmented pattern. The fine cracks produced are generally less than about 0.5 mm in width.

The crack inducers are preferably elongate, they can be of any suitable length and of any suitable shape when viewed in transverse cross section. For instance, an inducer can have a curved or polygonal cross section, such as circular, rectangular or triangular. The diameter and length of an inducer can vary depending on factors such as the size and purpose of the slab that is to be constructed, and whether slab reinforcing members are to be used (e.g., steel fabric or bar reinforcement). If desired, a crack inducer can comprise two or more elongate members stacked or bundled together.

A crack inducer can comprise any suitable material, whether manufactured or naturally occurring, and can be of solid or hollow construction. For instance, an inducer can comprise bamboo or milled timber. Preferably, an inducer comprises plastic material, such as a plastic conduit, e.g., a PVC pipe. The crack inducers can also be used to reticulate services (e.g., electrical services).

The crack inducers can be arranged in any suitable array which achieves the desired result. For instance, they can be arranged substantially parallel to one another or arranged as a grid. Preferably, the inducers are arranged as a rectangular grid comprising a first group of spaced, substantially parallel inducers, and a second group of spaced, substantially parallel inducers perpendicular to the first group.

Preferably, parallel crack inducers are spaced at about 800 mm to 3000 mm centers. This spacing, however, may vary depending on the type of slab that is to be poured, the thickness of the slab, whether slab reinforcing members are to be used (e.g., fabric or bar reinforcement), and the surface finish. Crack inducers spaced at about 800 mm to 1000 mm centers can produce fine cracks and nearly invisible cracks.

If the slab is to be subjected to significant fluctuations in temperature, the method can comprise a step of incorporating expansion joints. Preferably, the method further comprises a step of stabilizing the crack inducers to prevent excessive movement thereof. The crack inducers can be stabilized by anchoring the inducers to the surface with fasteners (e.g., stakes, pegs or the like if the slab is poured on grade/subgrade; staples, nails or the like if the slab is poured on formwork).

Alternatively, or additionally, the crack inducers can be stabilized by connecting at least some of the inducers to one another with connectors. The connector can comprise a body and at least two arms extending from the body, wherein each arm is attachable to an end of a crack inducer. The arms can be of any suitable shape and size. The arms can be attachable to crack inducers of slightly varying diameter. Preferably, each arm friction fits to an end of an inducer, but the arms can be attached in any other suitable way.

The arms can be of hollow construction. The connector can be, for instance, an electrical junction box or fitment. Junction boxes and the like are well known in the art. Alternatively, each arm can comprise a plurality of fingers that extend from the body and which friction fit to an end of a crack inducer.

Alternatively, and preferably, each arm is provided by at least one blade that extends from the body and which friction fits within an end of a crack inducer. The blade or blades can be of any suitable shape, size and configuration.

Preferably, each arm comprises two blades that intersect at a midpoint such that an end of each arm is cross-shaped when viewed in transverse cross section. Such a configuration enables crack inducers with slightly different diameters to be readily attached. The blades can also have ends that are tapered to facilitate attachment. Preferably, the connector has four arms extending radially from the body. The blades can also comprise flexible or flexibly resilient material, so as to facilitate attachment.

The method can further comprise a step of holding at least one of the connectors in position on the surface before pouring the slab. The connector can simply be held in place with a slab reinforcing member (steel fabric and/or bar reinforcement) placed atop the connector.

Alternatively, or additionally, the connector can have securing means for being held against the surface. The securing means can be provided by the body having at least one aperture through which a nail, spike, peg or the like can extend.

The connectors can function as bar chairs. The connector can have a region for supporting steel fabric and/or bar reinforcement. The body can have at least one upstanding wall, a top region of which provides the support. Preferably, the connector has four upstanding walls. The top region of each wall can have a retainer extending therefrom for engaging a slab-reinforcing member.

In a first preferred form of the invention, the connector comprises a cylindrical body with four arms extending from the body, wherein each arm comprises two blades that intersect at a midpoint such that an end of each arm is cross-shaped when viewed in transverse cross section. The connector can be fastened to the surface with a fastener extending through the cylindrical body. Such a connector can be used, for instance, with a fiber-reinforced slab.

In a second preferred form of the invention, the connector of the first preferred form can further comprise a ground-bearing base from which extends the cylindrical body, the base having a plurality of apertures through which fasteners (e.g., nails, spikes and the like) can extend. The connector can further have a raised reinforcement lip extending about a periphery of the base. This lip can be continuous with some of the blades of the arms. Such a connector can be used, for instance, with a fiber-reinforced slab.

In a third preferred form of the invention, the connector can comprise:

a body comprising:

a ground-bearing base having a plurality of apertures through which fasteners can extend to secure the connector to the surface;

four walls that extend upwardly from the base and which intersect at a central location of the body; and a retainer that extends from a top of each the wall, wherein the retainer is adapted to engage a slab reinforcing member; and arms in the form of blades that extend radially from an edge of each the wall and the base.

Preferably, the connectors comprise corrosion-resistant or non-corrosive material such as plastic material. The connectors can be produced by plastic injection molding.

The term "comprise", or variations of the term such as "comprises" or "comprising", are used herein to denote the inclusion of a stated integer or stated integers but not to exclude any other integer or any other integers, unless in the context or usage an exclusive interpretation of the term is required.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

In all of the Figures, like reference numerals refer to like parts.

DETAILED DESCRIPTION OF THE INVENTION

The Figures show a crack inducer system for inducing cracks in a large continuous concrete slab 1. The system comprises a plurality of crack inducers 2 arranged relative to a concrete-pouring surface 3 and adapted to be cast in concrete. The inducers 2 are sized, shaped and spaced to promote fine cracking in the vicinity of the inducers 2 throughout the area of the slab when the concrete begins to set.

Figure 1:
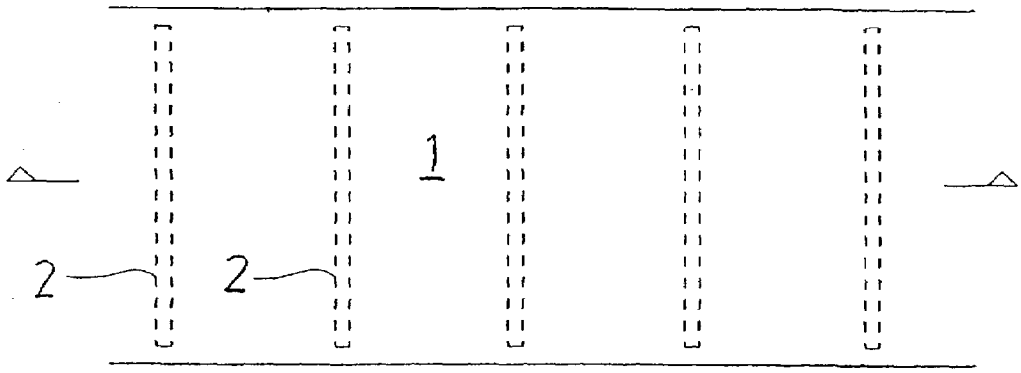
FIG. 1 is a detailed top plan view of a crack inducer system cast in a concrete slab, according to an embodiment of the invention.
Figure 2:
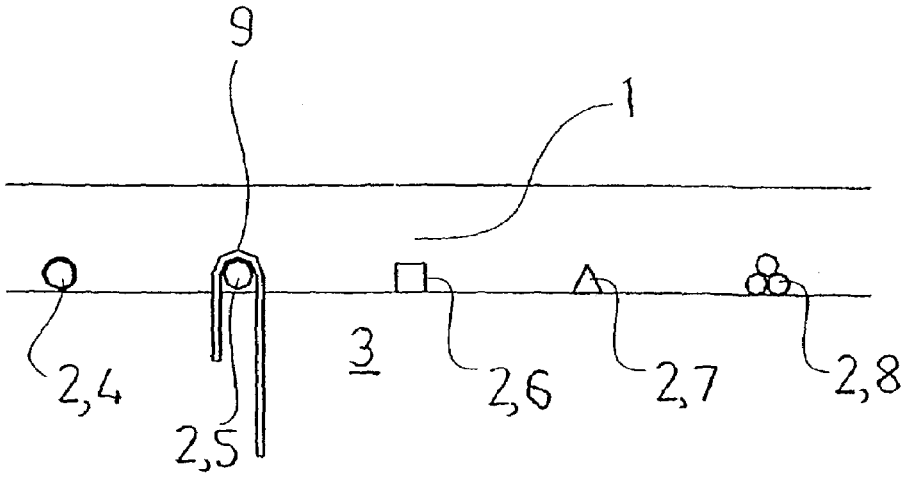
FIG. 2 is a cross sectional view of the crack inducer system and slab of FIG. 1.

FIGS. 1–5 show that the crack inducers 2 are elongate. FIG. 2 shows that the inducers 2 can be, for example, circular 4, hexagonal 5, rectangular 6 or triangular 7 when viewed in transverse cross section. FIG. 2 further shows that a crack inducer 2 can comprise several elongate members 8 stacked or bundled together.

Figure 3:
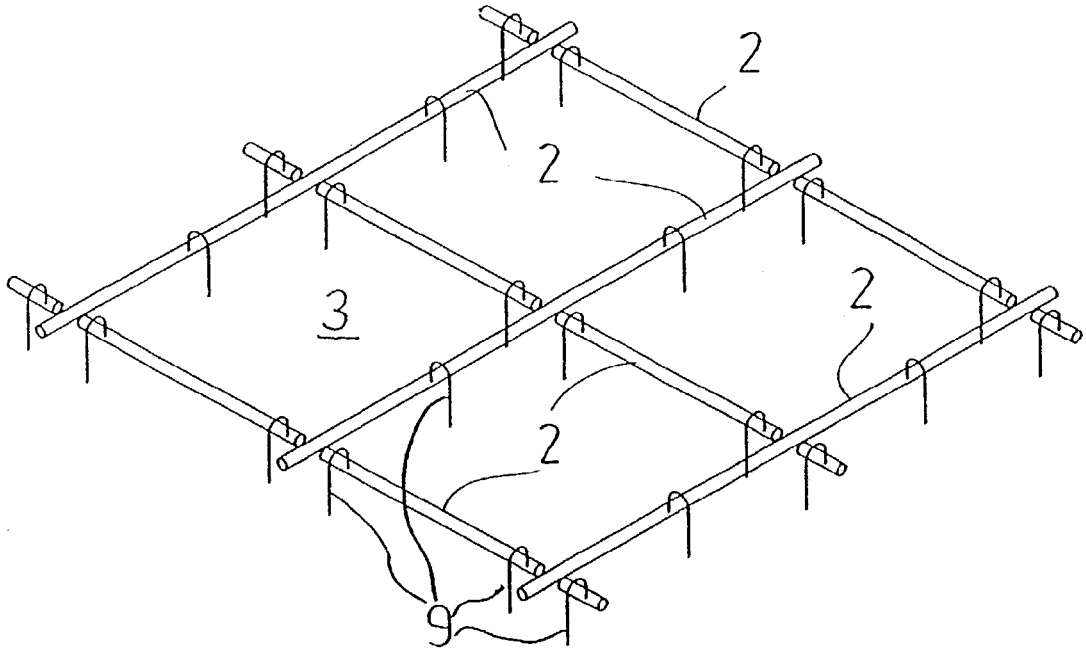
FIG. 3 is a detailed perspective view of a crack inducer system according to an embodiment of the invention.
Figure 4:
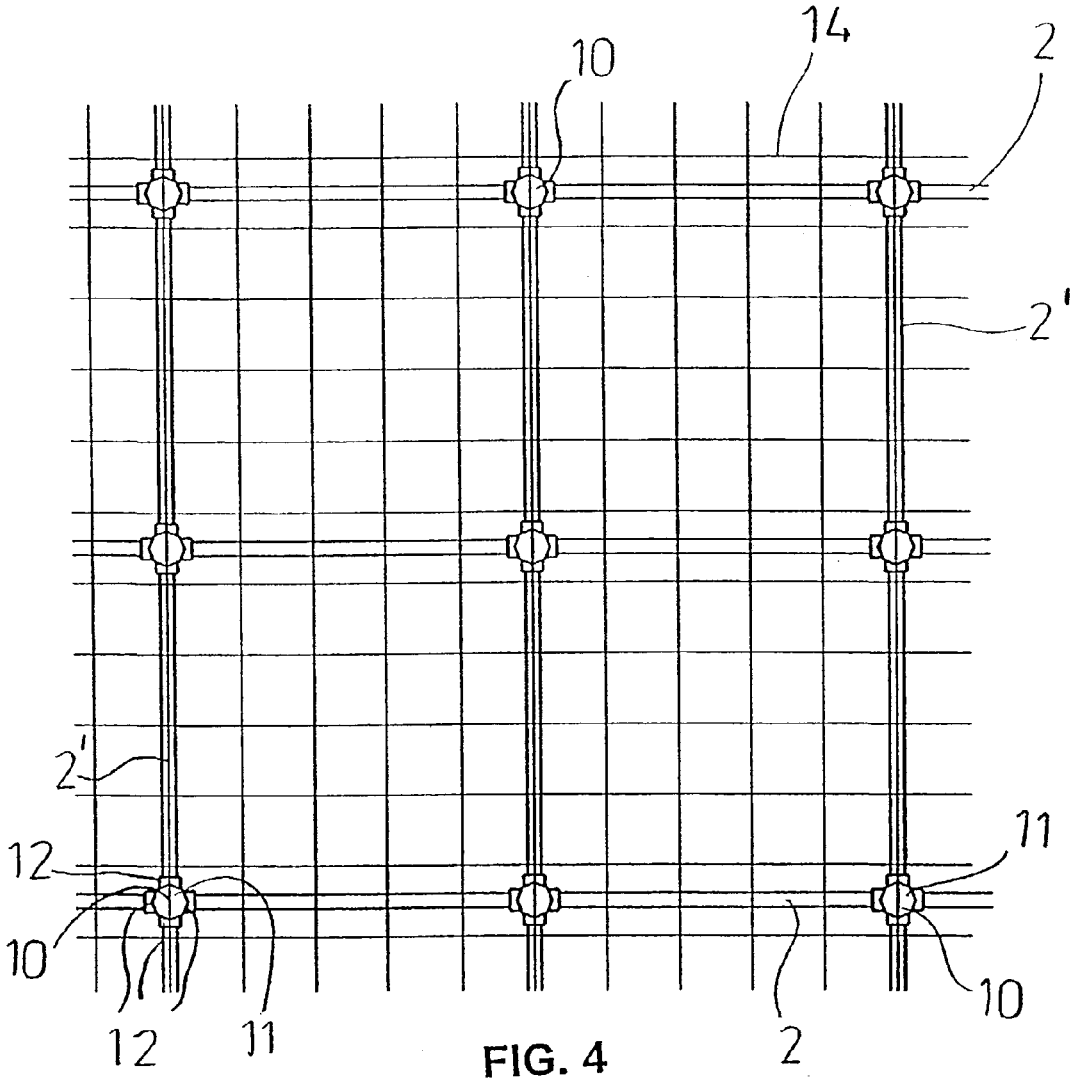
FIG. 4 is a top plan view of a crack inducer system according to an embodiment of the invention.
Figure 5:
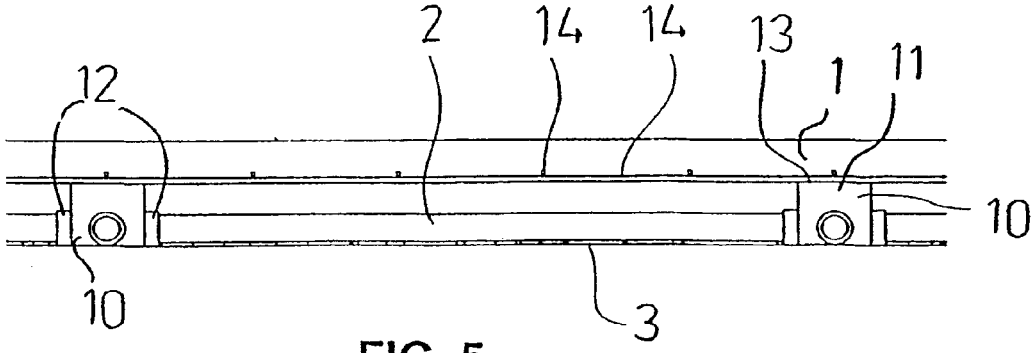
FIG. 5 is a cross sectional view of the crack inducer system of FIG. 4 but cast in a concrete slab.

FIGS. 3–5 show a particularly preferred embodiment of the invention wherein the crack inducers 2 comprise PVC pipes. Crack Inducers 2 of this form can be used to reticulate services, e.g., electrical services.

FIGS. 2 and 3 show that the crack inducers 2 can be held in place on the surface (to be covered with the slab) with pegs 9 or the like (if grade or subgrade), or with nails or the like (if formwork).

FIG. 1 shows that the crack inducers 2 can be arranged substantially parallel to one another. This may be desirable when constructing a continuous narrow pavement or path. FIGS. 3 and 4 show that for slabs of greater breadth (e.g., driveways), the inducers 2 can be arranged as a rectangular grid. The grid comprises a first group of spaced, substantially parallel inducers 2 and a second group of spaced, substantially parallel inducers 2' perpendicular to the first group.

Figure 8:
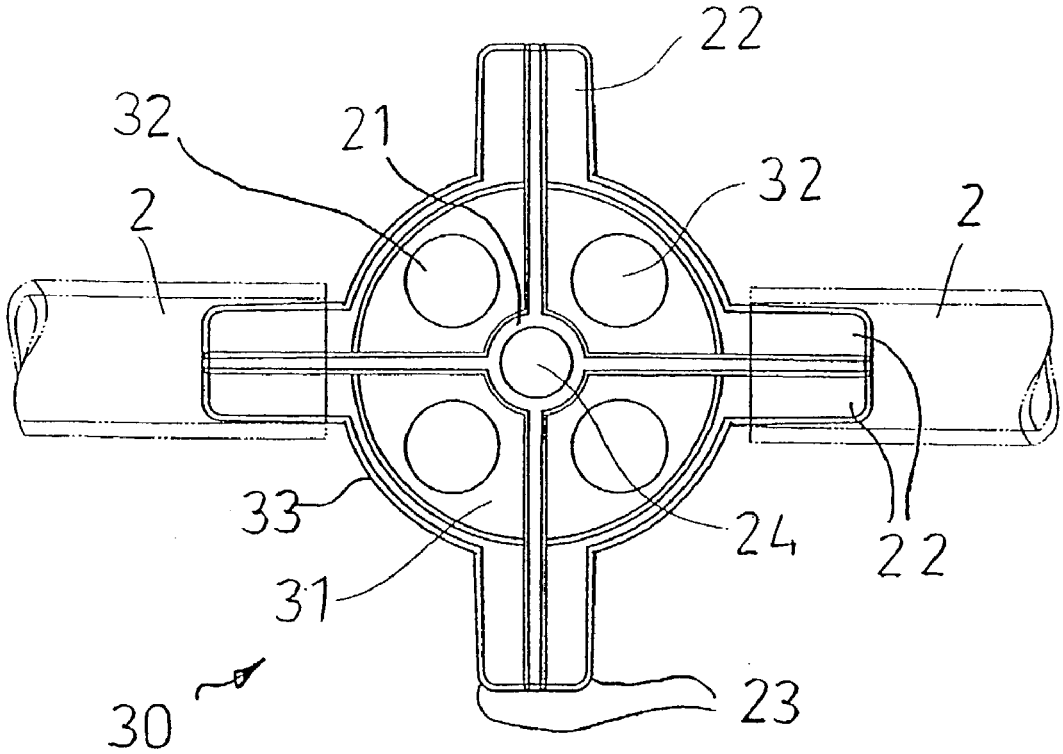
FIG. 8 is a detailed top plan view of the connector of FIG. 7 shown attached to some crack inducers of a crack inducer system.
Figure 6:
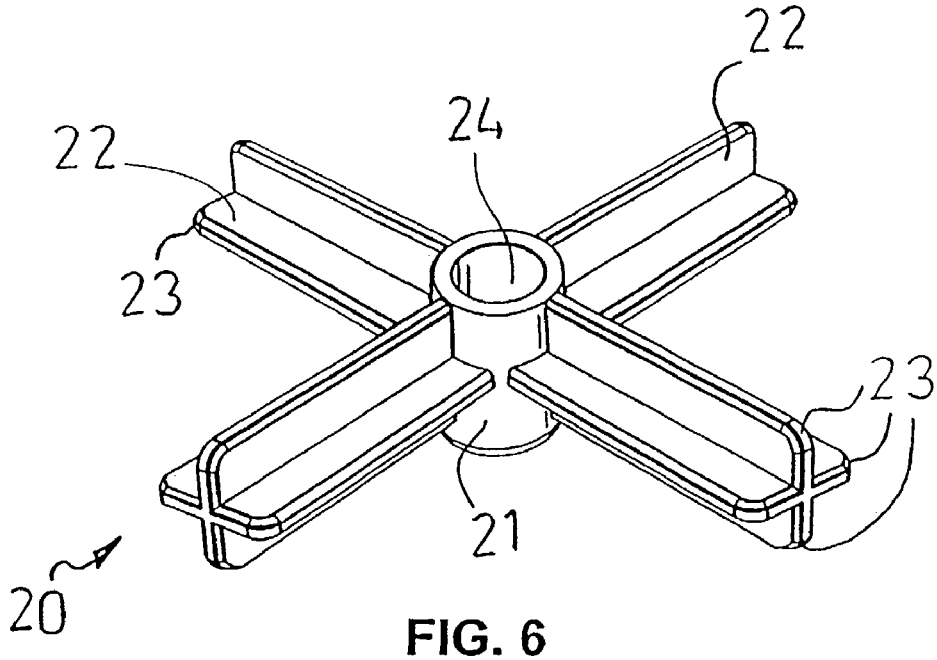
FIG. 6 is a perspective view of a connector of a crack inducer system according to an embodiment of the invention.
Figure 11:
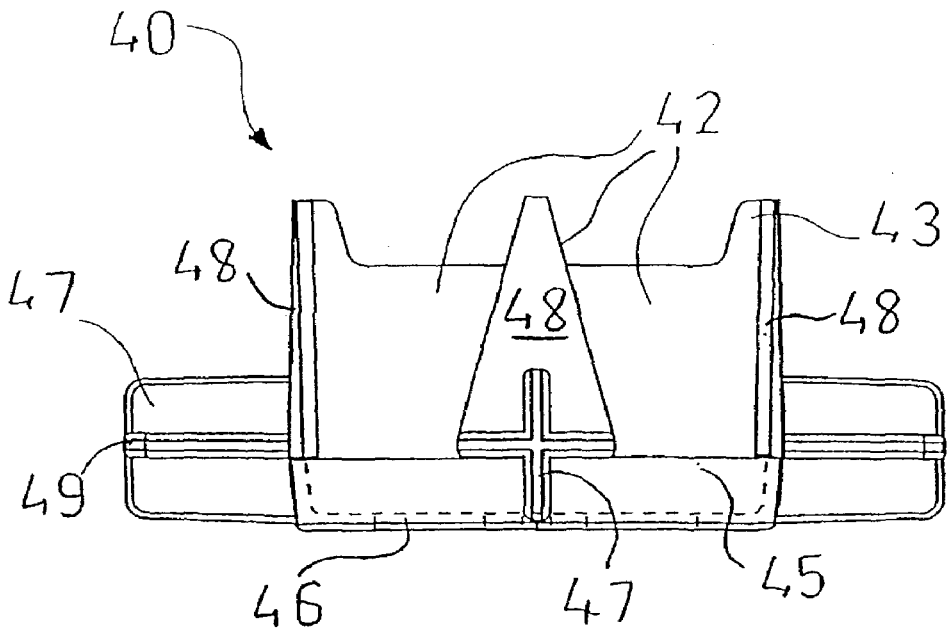
FIG. 11 is a detailed side elevation view of the connector of FIG. 10.
Figure 7:
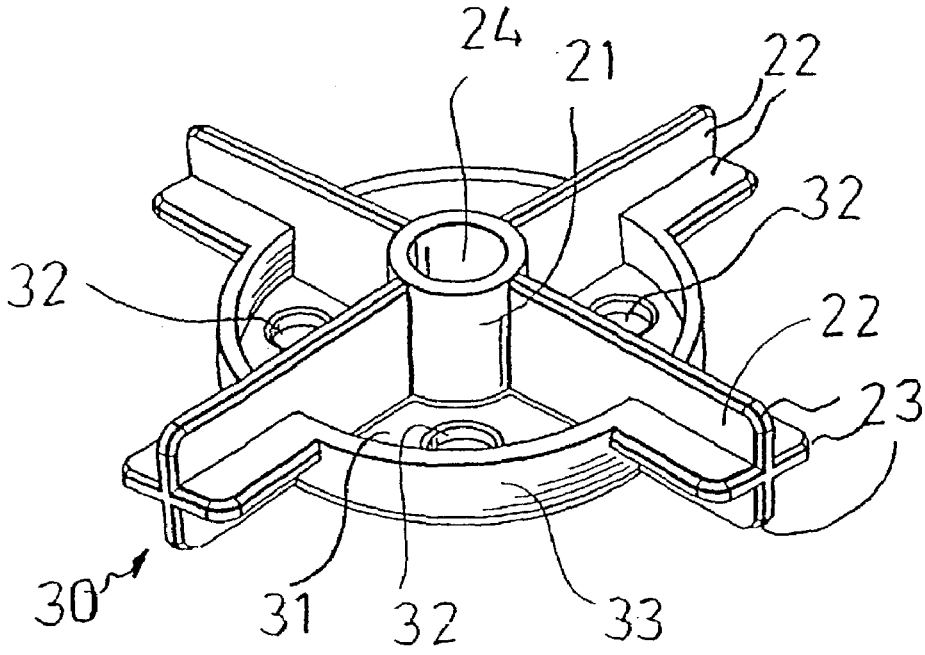
FIG. 7 is a perspective view of a connector of a crack inducer system according to an embodiment of the invention.
Figure 9:
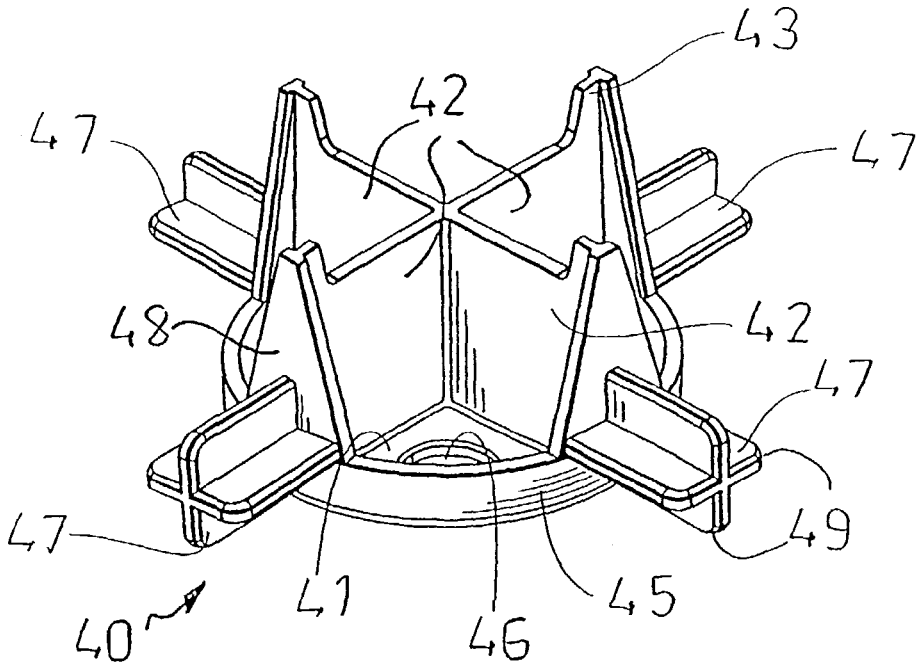
FIG. 9 is a perspective view of a connector of a crack inducer system according to an embodiment of the invention.
Figure 10:
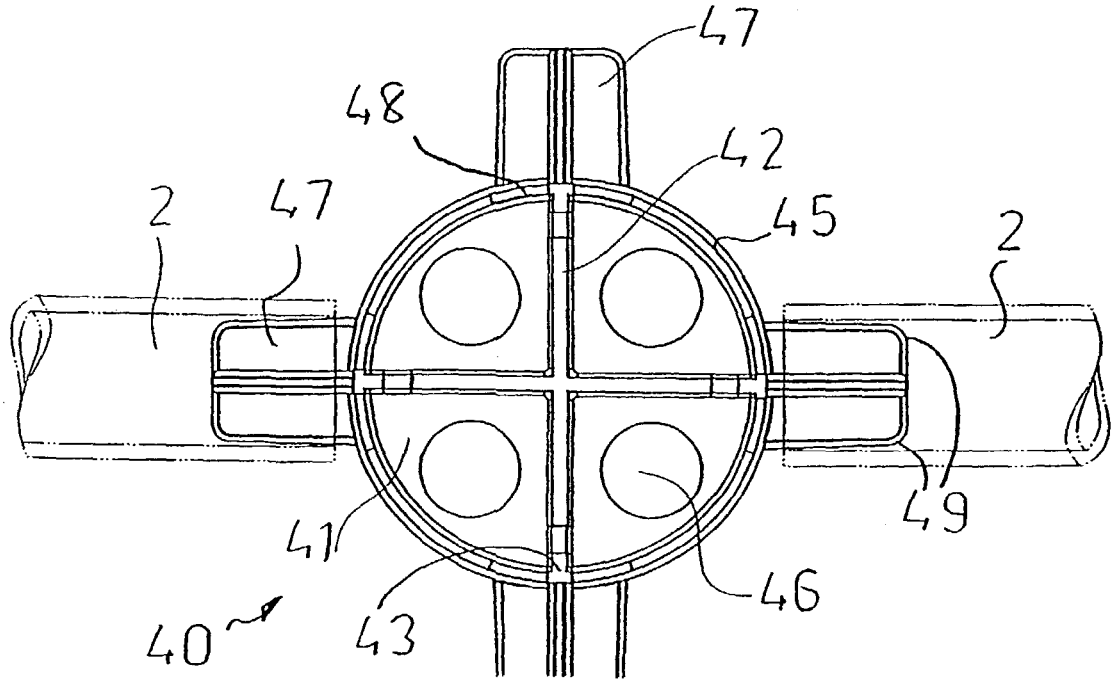
FIG. 10 is a detailed top plan view of the connector of FIG. 9 shown attached to some crack inducers of a crack inducer system.

The crack inducers 2 are preferably connected to one another with connectors. Various embodiments of connectors are shown in FIGS. 4–11. The connectors generally have a body and four arms extending therefrom. FIGS. 4 and 5 show a first embodiment of the connector 10, FIG. 6 shows a second embodiment of the connector 20, FIGS. 7 and 8 show a third embodiment of the connector 30, and FIGS. 9–11 show a fourth embodiment of the connector 40. Connectors 20, 30 and 40 are preferably produced by plastic injection molding.

Referring now to FIGS. 4 and 5, the connector 10 is an electrical junction box. The box 10 has a central generally cylindrical body 11 and four arms 12 extend from the body 11. Each of the arms 12 is hollow in construction and is attachable to an end of a crack inducer 2 or 2'. The box 10 can serve as a bar chair, wherein steel mesh 14 rests on a top surface 13 of the box 10.

Referring now to FIG. 6, the connector 20 comprises a cylindrical body 21 with four arms 22 extending from the body 21. Each arm 22 comprises two blades 22 that intersect at a midpoint such that an end of each arm 22 is cross-shaped when viewed in transverse cross section. Each arm 22 can friction fit to an internal surface of an end of an inducer 2 and can fit to inducers of slightly varying diameter as the inducers 2 can flex somewhat. The blades 22 are tapered at their ends 23 to further facilitate attachment.

The connector 20 can be held to the surface below by driving a peg, stake or the like through an aperture 24 of the cylindrical body 21. Connector 20 is of most use with fiber-reinforced slabs where steel mesh and bar reinforcement are not needed.

Referring now to FIGS. 7 and 8, connector 30 is similar to connector 20, except that it further has a ground-bearing base 31 from which extends the cylindrical body 21. The base 31 has a plurality of apertures 32 through which nails, spikes and the like may be driven into the surface below. The base 31 also has a raised reinforcement lip 33 extending about a periphery of the base 31 and the lip 33 is continuous with some of the blades 22. Such a connector 30 is of most use when constructing a fiber-reinforced slab.

Referring now to FIGS. 9–11, the connector 40 has a body comprising a ground-bearing base 41, four walls 42 that extend upwardly from the base 41 and which intersect at a central location of the body, and a retainer 43 that extends from a top of each wall 42. The retainer 43 is adapted to engage a slab reinforcing member such as steel mesh, so that the steel mesh cannot slip off by accident.

The connector 40 also has four arms 47 each of which comprises two blades 47 that intersect at a midpoint such that an end of each arm 47 is cross-shaped when viewed in transverse cross section.

The base 41 has a raised reinforcement lip 45 extending about a periphery of the base 41. The base 41 also has a plurality of apertures 46 through which nails, spikes or the like may be driven into the ground to secure the connector 40 to the surface below.

Each wall 42 has a vertical end wall 48 that is situated above the lip 45. The end walls 48 taper towards the respective retainer 43. Each arm 47 extends from an end wall 48 and from the lip 45. The blades 47 have tapered ends 49 to facilitate attachment to the crack inducers 2.

In use, crack inducers are arranged on grade/subgrade or on a plastic membrane laid on grade/subgrade. The inducers may be arranged as shown in FIG. 1 for narrow slabs (e.g., pathways) or as shown in FIGS. 3–5 for wider slabs (e.g., driveways, flooring). The inducers are spaced at about 800 mm–3000 mm centers, preferably about 800 mm–1000 mm centers. The ends of the inducers are connected with connectors. The inducers and/or connectors may be fastened to the surface below.

The connectors may double as bar chairs if steel fabric and/or bar reinforcement is to be used. If required, additional conventional bar chairs may be used. For suspended slabs, the crack inducers may be cast between top and bottom reinforcing members.

Once the crack inducers, connectors and reinforcing members are in place, the concrete is poured and allowed to set. If the slab is likely to be subjected to major fluctuations in temperature, then conventional expansion joints may be used. Cold joint pour breaks, otherwise known as construction joints, can be used to break up the construction into manageable daily portions. As the concrete sets, a multitude of fine cracks propagates around the crack inducers, as opposed to large cracks propagating at distant and random centers.

The crack inducer system enables concrete slabs of virtually any size to be poured directly on grade without the need for control joints. The system components are quick and easy to install, and result in significantly cheaper construction and maintenance of slabs for retail, commercial and industrial purposes.

Conventional slabs on grade for retail, commercial and light industrial developments would generally contain formed or sawn control joints at about 5–15 m centers in both directions. If the centers are increased, then there would usually also be an increase in the reinforcement.

The concept with conventional slabs on grade is that the control joints accommodate all of the shrinkage and thermal contraction strains, and that the reinforcement mesh limits crack width within each slab panel. It follows that the greater the spacing of the control joints, the larger the movement that has to be accommodated at each joint. The alternatives to date have been heavily reinforced continuous pavements and post-tensioned slabs. Both have been used to reduce the need for control joints when the cost increase can be justified, but neither is normally used for retail, commercial and light industrial floor slabs. Special detailing is required with these systems, and there is much room for error during construction. Also, problems often arise in accommodating the large movements that occur at the extremities of such slabs.

The present inventors have moved in the opposite direction with the crack inducer system. Rather than increase the spacing of control joints and hence the potential movement that occurs at them, the inventors have replaced the joints with induced, regularly spaced fine cracks. Rather than increase the reinforcement for crack control of large slab panels, the inventors have reduced it. Rather than providing for restraint-free shrinkage of large slab panels, the inventors have introduced restraint throughout the entire slab to assist crack induction at close centers.

The system revolves around the broad concept of inducing closely-spaced, hairline cracks above the crack inducers, so that the cracks will be of no consequence to the structural performance of the slab. The pattern of hairline cracks does not require surface treatment, does not adversely affect surface finishes if they are correctly applied, and is generally of no concern aesthetically. Further, there is minimal accumulation of stress in the bonding medium of any subsequently laid floor finishes, and no control joints to be reflected in the finishes.

Importantly, the cracks are induced from the moment the concrete begins to set. This, combined with the uniform spacing of the crack inducers and the uniformity of the slab and its reinforcement, provides the best possible opportunity for cracks to occur only where they are intended. With conventional sawn joints, for example, the initial wandering crack has often occurred before the saw cut is installed.

Also in contrast to conventional systems, where it is normal to implement measures to minimize restraint from the subgrade (e.g., sand blinding layers), with the present system, special measures may be taken to increase subgrade friction and general shrinkage restraint, as they both help to ensure the cracks are induced at the regular centers.

The connectors can double as the reinforcement support. The reinforcing steel mesh is simply placed onto the connectors and the need for traditional bar chairs is generally eliminated. The connectors provide an extremely stable support for the reinforcing mesh, and in return the weight of the mesh is sufficient to hold the connectors and crack inducers in place during concrete placement.

EXAMPLE

A specific example of slab construction will now be described. The crack inducer system has been used to construct a 4,042 square meter floor area for a supermarket, without control joints. The slab was 125 mm thick throughout and was reinforced with F62 mesh placed with about 30 mm top cover. A grid of crack inducers was used to induce closely spaced fine cracks throughout the area of the slab. The crack inducer grid comprised 33 mm diameter PVC pipes at 1 m centers in both x and y planar directions, the diameter of the pipes being approximately 25% of the thickness of the slab. Four-way connectors were used to connect the crack inducers and to provide a surface at 70 mm above the concrete-pouring surface to support the reinforcing mesh. The slab extended throughout the entire area of the supermarket, including the trading area, the cool rooms, the food preparation areas, and the reserves area.

Some of the advantages of the system for constructing slabs on grade can be summarized as follows:

All formed and sawn control joints, together with sealants, are eliminated

Reinforcement requirements may be reduced

Skilled labor is not required to install the crack inducer/connector grid

There are no formed or sawn control joints to have their edges broken or damaged during construction or during service The closely spaced pattern of fine cracks maximizes the ability of a slab to accommodate minor ground movements without distress There is minimal and generally no risk of slab panels curling at the corners Large continuous areas of slab can be placed in a single concrete pour, the limitation generally being only the capacity of the contractor to place and finish the concrete Construction joints at pour breaks can be installed at short notice with minimum effort There are no control joints to be reflected in the applied finishes Conventional machinery can be used There are significant reductions in construction time and cost produced by each of the above.

While the above has been given by way of illustrative example of the invention, many modifications and variations may be made thereto by persons skilled in the art without departing from the broad scope and ambit of the invention as herein set forth.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method of constructing a large continuous concrete slab, the method comprising the steps of:

extending a grid of crack inducers over a prepared ground surface, wherein the crack inducers extend in at least two different directions relative to one another over a length and breadth of the prepared ground surface and are spaced about 800 mm to 3000 mm from one another;

pouring concrete onto the prepared ground surface to completely cover the crack inducers; and allowing the concrete to set to form a slab, wherein the crack inducers of the grid are of a size, shape and spacing so as to relieve the build up of tensile stresses within the slab by inducing formation of fine cracks that generally extend between an upper surface of each crack inducer and a top surface of the slab, wherein the top surface of the slab is continuous, wherein the fine cracks are generally less than about 0.5 mm in width, and wherein installation of shrinkage control joints through the top surface is not required to prevent uncontrolled cracking.

2. The method of claim 1, wherein the slab has a surface area of at least about 300 $m^2$.

3. The method of claim 1, wherein the crack inducers are arranged substantially parallel to one another.

4. The method of claim 1, wherein the crack inducers are arranged as a rectangular grid comprising a first group of spaced, substantially parallel inducers, and a second group of spaced, substantially parallel inducers perpendicular to the first group.

5. The method of claim 1, wherein the crack inducers are spaced about 800 mm to 1000 mm from one another.

6. The method of claim 1, wherein the crack inducers are used to reticulate services.

7. The method of claim 1, further comprising a step of stabilizing at least one crack inducer prior to pouring the concrete.

8. The method of claim 7, wherein the at least one crack inducer is stabilized by anchoring the inducer to the prepared ground surface with a fastener.

9. The method of claim 7, wherein the at least one crack inducer is stabilized by connecting the inducer to at least one other crack inducer.

10. The method of claim 9, wherein the crack inducers are connected to one another with connectors.

11. The method of claim 10, wherein the connectors are attachable to crack inducers of slightly varying diameter.

12. The method of claim 10, further comprising a step of holding at least one of the connectors relative to the prepared ground surface before pouring the slab.

13. The method of claim 12, wherein the connector is held in position with a slab reinforcing member placed atop the connector, wherein the connector functions as a bar chair.

14. The method of claim 12, wherein the connector has securing means for being held against the prepared ground surface.

15. The method of claim 1, wherein the crack inducers comprise conduits.

16. The method of claim 1, wherein the crack inducers comprise bamboo.

17. A crack inducer system for inducing cracks in a large continuous concrete slab, the system comprising a grid of crack inducers extending over a prepared ground surface, wherein the crack inducers extend in at least two different directions relative to one another over a length and breadth of the prepared ground surface and are spaced about 800 mm to 3000 mm from one another, wherein the crack inducers are completely covered by concrete in order to form a slab and the crack inducers are of a size, shape and spacing so as to relieve the build up of tensile stresses within the slab by inducing formation of fine cracks that generally extend between an upper surface of each crack inducer and a top surface of the slab, and wherein the top surface of the slab is continuous having fine cracks generally less than about 0.5 mm in width without requiring installation of shrinkage control joints through the top surface of the slab to prevent uncontrolled cracking.

18. The system of claim 17, wherein the crack inducers are elongate.

19. The system of claim 17, wherein the crack inducers are elongate and have a transverse cross sectional shape selected from the group consisting of circular, rectangular and triangular.

20. The system of claim 17, wherein at least one of the crack inducers comprises at least two elongate members stacked or bundled together.

21. The system of claim 17, wherein at least one of the crack inducers is selected from the group consisting of a conduit and a piece of bamboo.

22. The system of claim 21, wherein the conduit is a plastic pipe.

23. The system of claim 17, wherein the crack inducers are arranged substantially parallel to one another.

24. The system of claim 17, wherein the crack inducers are arranged as a rectangular grid comprising a first group of spaced, substantially parallel inducers, and a second group of spaced, substantially parallel inducers perpendicular to the first group.

25. The system of claim 17, wherein the crack inducers are spaced about 800 mm to 1000 mm from one another.

26. The system of claim 17, further comprising connectors connecting at least some of the crack inducers to one another.

27. The system of claim 26, wherein at least one of the connectors comprises a body and a plurality of arms extending from the body, wherein each arm is attachable to an end of one of the crack inducers.

28. The system of claim 27, wherein each arm is attachable to crack inducers of slightly varying diameter.

29. The system of claim 27, wherein each arm is of hollow construction.

30. The system of claim 27, wherein each arm comprises at least one blade extending from the body and which friction fits within an end of one of the crack inducers.

31. The system of claim 30, wherein each arm comprises two blades that intersect at a midpoint such that an end of each arm is cross-shaped when viewed in transverse cross section.

32. The system of claim 31, wherein the blades have tapered ends to facilitate attachment to the crack inducers.

33. The system of claim 27, wherein the connector has four arms extending radially from the body.

34. The system of claim 27, wherein the connector is an electrical junction box or fitment.

35. The system of claim 27, wherein the connector has securing means for being held against the prepared ground surface.

36. The system of claim 35, wherein the securing means comprises the body having at least one aperture through which a fastener extends.

37. The system of claim 27, wherein the body of the connector has at least one upstanding wall having a top region which provides support for a reinforcing member.

38. The system of claim 37, wherein the connector has four upstanding walls and the top region of each wall has a retainer extending therefrom for engaging a reinforcing member.

39. The system of claim 27, wherein the connector comprises a cylindrical body with four arms extending radially from the body, wherein each arm comprises two blades that intersect at a midpoint, such that an end of each arm is cross-shaped when viewed in transverse cross section, and wherein the connector has at least one aperture for receiving a fastener extending through the cylindrical body for securing the connector to the prepared ground surface.

40. The system of claim 39, wherein the connector further comprises a ground-bearing base from which the cylindrical body extends, the base having a plurality of apertures through which fasteners extend.

41. The system of claim 40, wherein the connector further has a raised reinforcement lip extending about a periphery of the base, and the lip is continuous with at least some of the blades of the arms.

42. The system of claim 27, wherein the connector comprises:

a body having:

a ground-bearing base having a plurality of apertures through which fasteners extend to secure the connector to the prepared ground surface;

four walls extending upwardly from the base and intersecting at a central location of the body; and a retainer extending from a top of each wall, wherein the retainer is adapted to retain a slab reinforcing member; and the plurality of arms is in a form of blades extending radially from an edge of each wall and from the base.

43. The system of claim 42, wherein the connector comprises corrosion-resistant or non-corrosive material.

44. The system of claim 27, wherein the connector comprises an injection-molded plastic.

* * * * *